US010309192B2

(12) United States Patent
Techentien et al.

(10) Patent No.: US 10,309,192 B2
(45) Date of Patent: Jun. 4, 2019

(54) ONE TRIP COMPLETION ASSEMBLY SYSTEM AND METHOD

(71) Applicant: Halliburton Energy Services, Inc., Houston, TX (US)

(72) Inventors: Bruce Wallace Techentien, Houston, TX (US); Travis Thomas Hailey, Jr., Sugar Land, TX (US); John Kenneth Oliver, Houma, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/543,907

(22) PCT Filed: Dec. 7, 2016

(86) PCT No.: PCT/US2016/065350
§ 371 (c)(1),
(2) Date: Jul. 14, 2017

(87) PCT Pub. No.: WO2017/105958
PCT Pub. Date: Jun. 22, 2017

(65) Prior Publication Data

US 2018/0283132 A1 Oct. 4, 2018

Related U.S. Application Data

(60) Provisional application No. 62/266,868, filed on Dec. 14, 2015.

(51) Int. Cl.
*E21B 33/12* (2006.01)
*E21B 34/06* (2006.01)
(Continued)

(52) U.S. Cl.
CPC ..... *E21B 34/06* (2013.01); *E21B 23/06* (2013.01); *E21B 33/12* (2013.01); *E21B 43/08* (2013.01); *E21B 43/10* (2013.01); *E21B 43/12* (2013.01)

(58) Field of Classification Search
CPC ..... E21B 34/06; E21B 23/06; E21B 33/12; E21B 43/08; E21B 43/10; E21B 43/12
See application file for complete search history.

(56) References Cited

U.S. PATENT DOCUMENTS

2007/0119599 A1 5/2007 Chavers et al.
2009/0025923 A1* 1/2009 Patel ..... E21B 43/045 166/51
(Continued)

FOREIGN PATENT DOCUMENTS

WO WO 2015/054020 A1 4/2015

OTHER PUBLICATIONS

International Search Report and The Written Opinion of the International Search Authority, or the Declaration, dated Mar. 3, 2017, PCT/US2016/065350, 17 pages, ISA/KR.

*Primary Examiner* — D. Andrews
*Assistant Examiner* — Yanick A Akaragwe
(74) *Attorney, Agent, or Firm* — Haynes and Boone, LLP

(57) ABSTRACT

A method for installing a production string in a wellbore and a production assembly for deployment in a wellbore are disclosed. An upper completion portion including a tubular and an upper circulation valve and a lower completion portion including a screen assembly and a lower circulation valve are together deployed into a wellbore at the same time. The upper circulation valve is movable between a closed position to block fluid communication between the interior and the exterior of the tubular and an open position to establish fluid communication between the interior and the exterior of the tubular. The lower circulation valve is mov-
(Continued)

able between an open position to establish fluid communication between the interior and the exterior of a base pipe deployed adjacent the screen assembly and a closed position to block fluid communication between the interior and the exterior of the base pipe.

14 Claims, 9 Drawing Sheets

(51) Int. Cl.

| | |
|---|---|
| ***E21B 43/08*** | (2006.01) |
| ***E21B 43/10*** | (2006.01) |
| ***E21B 43/12*** | (2006.01) |
| ***E21B 23/06*** | (2006.01) |

(56) References Cited

U.S. PATENT DOCUMENTS

| | | | | |
|---|---|---|---|---|
| 2013/0133883 | A1 | 5/2013 | Hill, Jr. | |
| 2013/0140040 | A1 | 6/2013 | George et al. | |
| 2014/0083702 | A1* | 3/2014 | Godfrey | C09K 8/422 166/295 |
| 2016/0024897 | A1* | 1/2016 | Greci | E21B 43/103 166/296 |

* cited by examiner

ONE TRIP COMPLETION ASSEMBLY SYSTEM AND METHOD

PRIORITY

The present application is a U.S. National Stage patent application of International Application No. PCT/US2016/065350, filed on Dec. 7, 2016, which claims priority to U.S. Provisional Patent Application No. 62/266,868, filed Dec. 14, 2015, both entitled, "ONE TRIP COMPLETION ASSEMBLY SYSTEM AND METHOD," and the disclosures of which are hereby incorporated by reference in their entirety.

TECHNICAL FIELD

The present disclosure relates generally to well completion and production operations and, more specifically, to running in and setting completion assemblies in a single trip.

BACKGROUND

In the process of completing an oil or gas well, the running in and setting of a completion assembly is typically a two trip procedure. The lower completion assembly is run in on a packer running tool. The lower completion assembly generally consists of a production packer/sand control packer and a screen assembly which together function as a flow regulating system. An inner tubing string is also hung off of the packer running tool and extends down to the bottom of the screen assembly. A circulation fluid is then pumped down the inner tubing string to the bottom of the screen assembly and back up the annulus between the lower completion assembly and the wellbore wall in order to displace formation, drilling and other fluids that may be present in the wellbore. Following circulation, the packer is set and the running tool with the inner string is retrieved from the wellbore. Thereafter, the upper completion assembly is run-in. Just after coupling the upper completion assembly to the lower completion assembly, a circulation fluid is pumped down through the upper completion assembly to displace any fluids that may be in the wellbore above the location of the packer.

Typically, the screen assembly consists of a base pipe wrapped with a filter, which may be in the form of a generally cylindrical screen. The screen has a multiplicity of entry points through which produced fluid (liquid and/or gas) passes through the screen to apertures formed in the base pipe. The base pipe, in turn, is in fluid communication with production tubing extending from the surface, thus permitting the produced fluids to flow to the surface. In some cases, the screen assembly may include an inflow control device (ICD) positioned adjacent to or in proximity to the screen. The ICD regulates the flow of the produced fluid to the base pipe apertures after the produced fluid passes through an entry point of the screen.

It would be desirable to provide a method for installing an entire single completion assembly in a single trip during which various fluids in the wellbore can be displaced by circulation.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
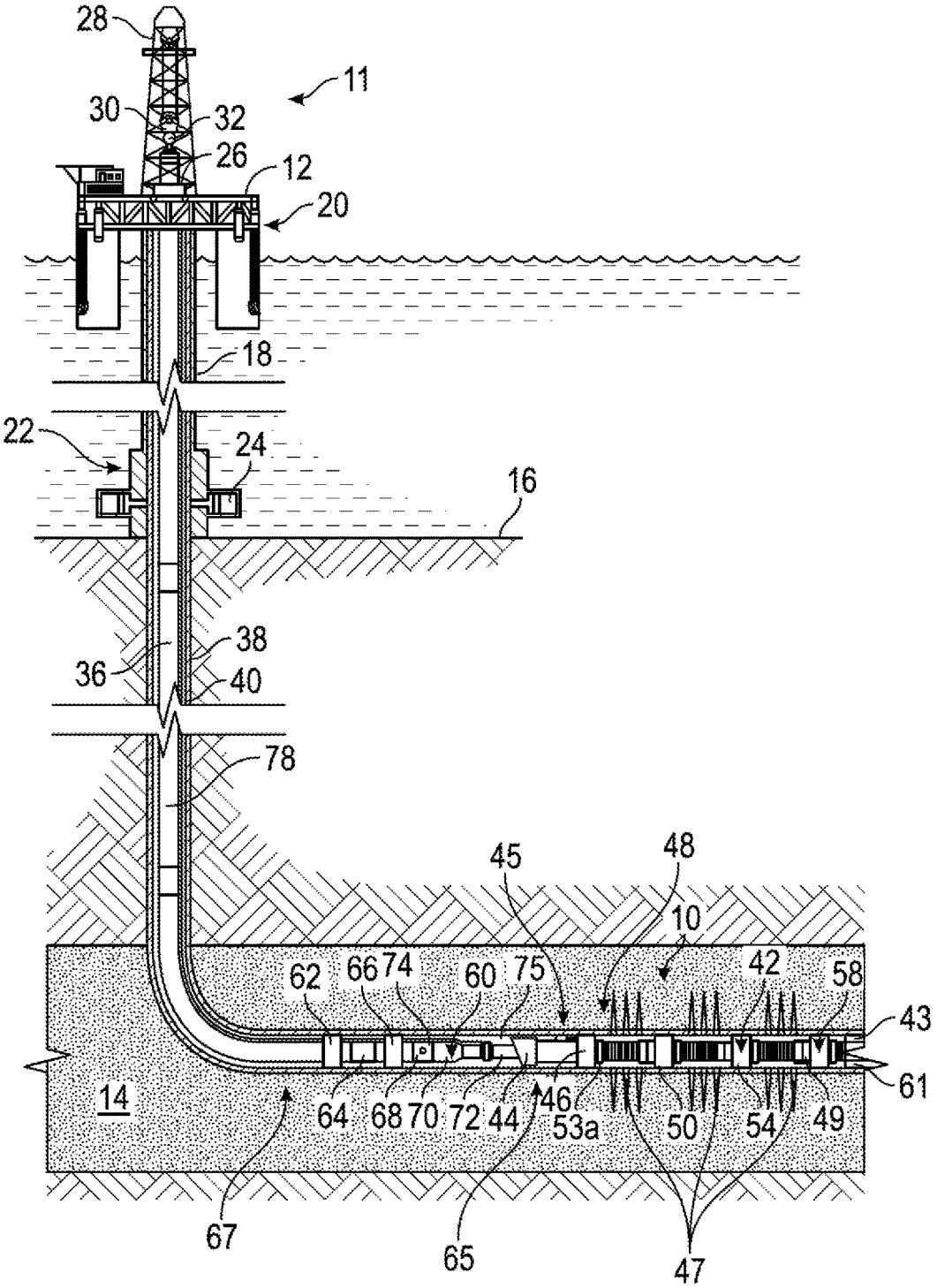
FIG. 1 is a schematic illustration of an offshore oil and gas platform operably coupled to a production string consisting of upper and lower production assemblies according to an embodiment of the present disclosure.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a figure may depict a horizontal wellbore or a vertical wellbore, unless indicated otherwise, it should be understood by those skilled in the art that the apparatus according to the present disclosure is equally well suited for use in wellbores having other orientations including vertical wellbores, deviated wellbores, multilateral wellbores or the like. Likewise, unless otherwise noted, even though a figure may depict an offshore operation, it should be understood by those skilled in the art that the apparatus according to the present disclosure is equally well suited for use in onshore operations and vice-versa. Further, unless otherwise noted, even though a figure may depict a cased hole, it should be understood by those skilled in the art that the apparatus according to the present disclosure is equally well suited for use in open hole operations.

Referring initially to FIG. 1, a production string 10 consisting of an upper portion and a lower portion is disposed as a single unit in a wellbore from an offshore oil or gas platform that is schematically illustrated and generally designated 11. A semi-submersible platform 12 is positioned over a submerged oil and gas formation 14 located below a sea floor 16. A subsea conduit 18 extends from a deck 20 of the platform 12 to a subsea wellhead installation 22, including blowout preventers 24. The platform 12 has a hoisting apparatus 26, a derrick 28, a travel block 30, a hook 32, and a swivel 34 for raising and lowering pipe strings, such as a substantially tubular, axially extending tubing string 36.

A wellbore 38 extends through the various earth strata including the formation 14 and has a casing string 40 cemented therein. Production string 10 is illustrated positioned in a substantially horizontal portion of the wellbore 38. Production string 10 includes a lower portion 42 having a distal end 43 and a proximal end 45. Production string 10 also includes an upper portion 60 having a distal end 65 and a proximal end 67. Spanning the upper portion 60 and lower portion 42 is a flow regulating system 48 which generally includes a an upper circulation valve 68, a production packer 46, a screen assembly 47 and a flow valve 53*a* positioned between the screen assembly 47 and the production packer 46. Although generally not limited to a particular valve type, in one or more embodiments, as described below, flow valve 53*a* is an isolation barrier valve, while in other embodiments, as described below, flow valve 53*a* is a circulation valve. The production packer 46 may be positioned adjacent the proximal end 45 of the lower portion 42, while the upper circulation valve 68 may be positioned adjacent the distal end 65 of the upper portion 60 so as to be in proximity to the production packer 46. Lower portion 42 may also include additional screen assemblies 47 and additional packers, such as packer 50 or packer 54. In one or more preferred embodiments, lower portion 42 may include a ball seat 49, a packer 58 and a float shoe 61. In embodiments, packer 58 may be a flow around packer. Finally, lower portion 42 may include various other components, such as a latch subassembly 44.

Production string 10 is disposed in the wellbore 38 at the lower end of the tubing string 36 so as to form an annulus 75 between the production string 10 and casing string 40 or the production string 10 and the wall of wellbore 38 in instances where wellbore 38 is not cased. Upper portion 60 includes at least one upper circulation valve or fluid flow control module 68, such as a circulating valve, and may further include various components such as a packer 62, an expansion joint 64, a packer 66 and an anchor assembly 70. Upper circulation valve 68 may be selectively operated to establish flow from the interior flow passage 78 of production string 10 to annulus 75 during circulating operations. In one or more embodiments, valve 68 may be a remotely controlled circulating valve. Valve 68 may be driven between a first closed position and a second open position. In one or more embodiments, during run-in of production string 10, valve 68 is set in the first closed position. Once production string 10 has been deployed and the lower portion 42 has been circulated as described below, valve 68 may be actuated to an open position to allow circulation of upper portion 60. In one or more embodiments, a control line, such as a tubing or conduit, may extend down to valve 68 and may be utilized to control valve 68. In this regard, valve 68 may be a dual (balanced) control line circulating valve for circulating above packer 46.

Upper portion 60 may also include a latch subassembly 72. One or more communication cables such as an electric cable 74 that passes through the packers 62, 66 may be provided and extend from the upper portion 60 to the surface in an annulus 75 between the tubing string 36 and the casing 40. The latch subassembly 44 couples to the latch subassembly 72 so upper portion 60 and lower portion 42 when joined together form a production string 10. It will be appreciated that in one or more embodiments, because upper portion 60 and lower portion 42 are made up together and run-in together, the need for latch subassemblies 44 and 72 during installation of production string 10 is obviated, and in this regard, latch subassemblies 44, 72 may be omitted. However, it may still be desirable to detach upper portion 60 from lower portion 42 at some point after installation of production string 10, and thus, in some embodiments, latch subassemblies 44, 72 are retained.

Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions. In one or more embodiments, upper portion 60 may be deployed in a cased portion of wellbore 38, while lower portion 42 may extend into an uncased portion of wellbore 38.

Figure 2:
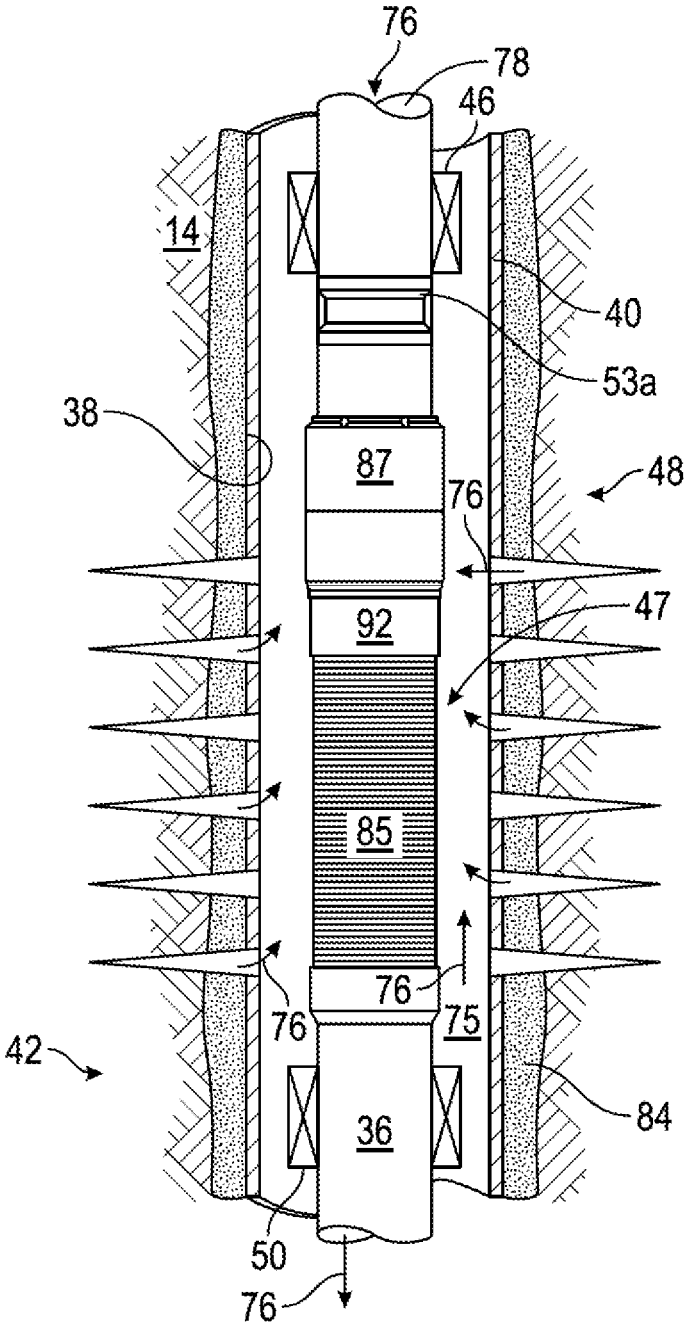
FIG. 2 illustrates a side view of a lower production assembly, according to an exemplary embodiment of the present disclosure.

FIG. 2 illustrates certain components of flow regulating system 48 generally encompassed by lower portion 42. Along lower portion 42, flow regulating system 48 restricts fluid communication between the annulus 75 and the interior flow passage 78 of the tubular string 36 adjacent the screen assembly 47 during run-in and [flow down] operations. As shown, the annulus 75 is formed radially between the tubular string 36 and the wellbore 38, either uncased or (as shown) lined with the casing string 40 and cement 84. During [flow down] operation, fluid 76 is pumped down interior flow passage 78 and out into the annulus 75 at a point below screen assembly 47. In one or more embodiments, fluid 76 flows past packer 58 and out float shoe 43 (see FIG. 1). Formation fluid 76 may also flow into annulus 75 from formation 14. During installation of production string 10 and during flow down operations, packer 46 is retained in a retracted position so that fluid 76 can flow by packer 46 in order to clear debris from annulus 75. It will be appreciated that once flow down operations are complete, packer 46 may be actuated to isolate the production zone from the annulus 75 above packer 46. In one or more embodiments, packer 46 may be a production packer. In one or more embodiments, packer 46 may be a pass through packer to allow cables and control lines to pas to lower portions of the production assembly 10. In addition to production packer 46, one or more additional packers, such as packer 50 may be deployed along lower portion 42 to isolate production zones and/or provide stability to uncased wellbore walls. Packer 50 may be a swell packer. In one or more embodiments, packer 46 may be a control line set production packer. In addition to packer 46, a lower circulation valve 53*a* is illustrated. It will be appreciated that lower circulation valve 53*a* may be selectively operated to control flow of fluid 76 along passage 78, and in particular, to allow fluid communication between the lower portion 42 of production string 10 and the upper portion 60 of production string 10. In one or more embodiments, valve 53*a* may be an isolation barrier valve. In one or more embodiments, valve 53*a* may be a circulation valve. In some embodiments, valve 53*a* may be remotely actuated, such as through the transmission of an acoustic signal, while in other embodiments, a control line running from platform 11 may be utilized to actuate valve 53*a*. Valve 53*a* may be driven between a first open position and a second closed position. In one or more embodiments, during run-in of production string 10, valve 53*a* is set in the first open position to allow wellbore fluids to pass into interior flow passage 78. In one or more embodiments, valve 53*a* is a ball valve. Valve 53*a* may be controlled by a dual (balanced) control line. In such case, packer 46 may be a feed/pass through packer.

Screen assembly 47 generally includes a screen 85. In some embodiments, screen assembly 47 may also include an inflow control device (ICD) 87. Generally, during production, screen 85 prevents or at least reduces the amount of debris, such as gravel, sand, and other particulate matter, from entering the interior flow passage 78. In one or more embodiments, the fluid 76 passing through the screen 85 then flows through the ICD 87 and into the interior flow passage 78 for eventual production to the surface, while in other embodiments, the fluid 76 passing through the screen 85 may flow along a defined flow path directly to the interior flow passage 78.

Figure 3:
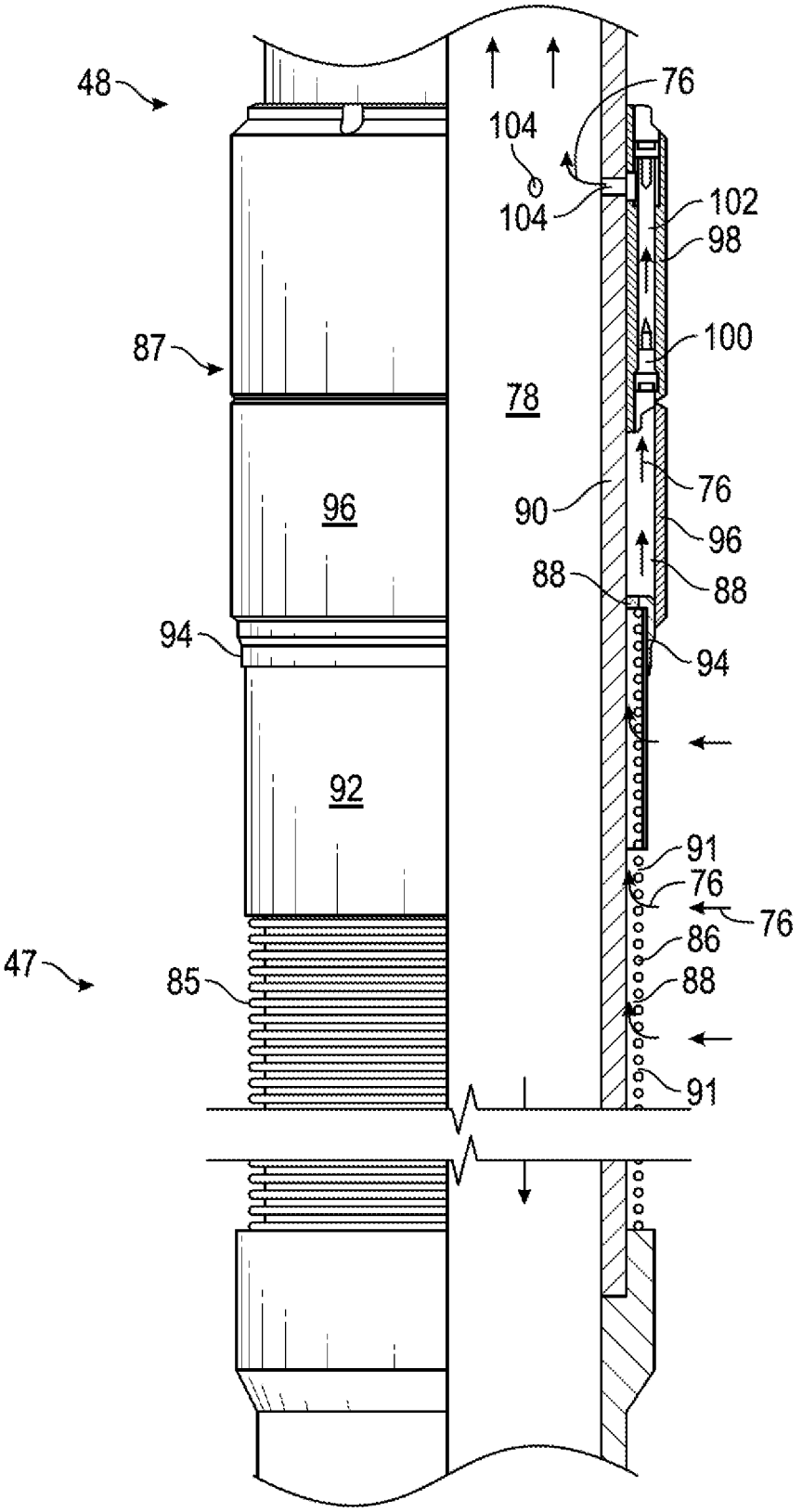
FIG. 3 illustrates a partial cross sectional view of a screen assembly and flow regulating system of a lower production assembly, according to an exemplary embodiment of the present disclosure.

FIG. 3 illustrates a more detailed partial cross sectional view of the flow regulating system 48, and in particular screen assembly 47 according to an exemplary embodiment. In one or more embodiments, the screen 85 of the flow regulating system 48 is a filter formed of wire 86 and disposed on an inner tubular member or base pipe 90. In one or more embodiments, screen 85 may be a swell screen. In one or more embodiments, the base pipe 90 is an elongated tubular member. Preferably, the wire 86 is wound or wrapped onto the base pipe 90 to form the screen 85. In other embodiments, screen 85 may be a wire or synthetic mesh. In one or more embodiments, the screen 85 is an elongated tubular member and is disposed on the base pipe 90 so as define an exterior flow path or passage 88 between the screen 85 and the base pipe 90. In one or more embodiments, gaps between the wires 86 form openings or entry points 91, through which the fluid 76 passes through the screen 85. The passage 88 may be defined utilizing standoff supports (not shown) arranged in parallel, and circumferentially spaced around the exterior surface of the base pipe 90 to support the screen 85 in a spaced apart arrangement from the base pipe 90. The passage 88 may also be defined between one or more adjacent screens 85 laid over one another or may be defined by the screen 85 itself. In any event, the passage 88 is formed to direct flow towards the interior flow passage 78, which is defined within the base pipe 90.

In one or more embodiments of flow regulating system 48 where an ICD 87 is included, the flow regulating system 48 may further include an interface ring 94 disposed about the exterior surface of the screen 85 to secure the screen 85 to the base pipe 90. In one or more embodiments, the interface ring 94 may be secured using a "shrink fit" to secure the screen 85 to the base pipe 90. A sleeve 96 is disposed in proximity to and/or about the exterior surface of the base pipe 90 defines a portion of the passage 88. In some embodiments, the sleeve 96 is supported by the interface ring 94. The ICD 87 is disposed adjacent or in proximity to the screen 85 along the base pipe 90, preferably concentrically disposed about the exterior surface of the base pipe 90. In an exemplary embodiment, the ICD 87 is configured to be coupled to the sleeve 96. In an exemplary embodiment, the ICD 87 includes one or more tubular structures 100, which restrict the flow of the fluid 76 from the passage 88 to an annular chamber 102 of ICD 87. Although only one of the tubular structures 100 is visible in FIG. 3, a series of the tubular structures 100 may be arranged in parallel, and circumferentially spaced apart within the ICD 87. The tubular structures 100 are one example of flow restrictors which may be used in the ICD 87. In an exemplary embodiment, other types of flow restrictors may be used, such as for example chokes, orifices, nozzles, etc. Any type of flow restrictor may be used in keeping with the scope of this disclosure. In an exemplary embodiment, the fluid 76 flows through the tubular structures 100 to the annular chamber 102. Thus, the tubular structures 100 provide for parallel flow of the fluid 76 from the passage 88 to the annular chamber 102. The fluid 76 flows from the chamber 102 and then inward via openings 104 in the base pipe 90 to the interior flow passage 78. The openings 104 are formed radially through the base pipe 90, which is configured (e.g., with threads at either end, etc.) for interconnection in the tubular string 36. Persons of skill in the art will appreciate that while ICD 87 is described in some embodiments of screen assembly 47, in other embodiments of screen assembly 47, an ICD 87 need not be included. For example, the base pipe 90 may be provided with the openings 104. The screen 85 having the shroud 92 overlays the base pipe 90. The screen 85 is longitudinally spaced apart from the openings 104 so the passage 88 extends longitudinally between the openings 91 of the screen 85 and the openings 104 to guide the fluid 76 flowing through the screen 85 to the openings 104.

Figure 4:
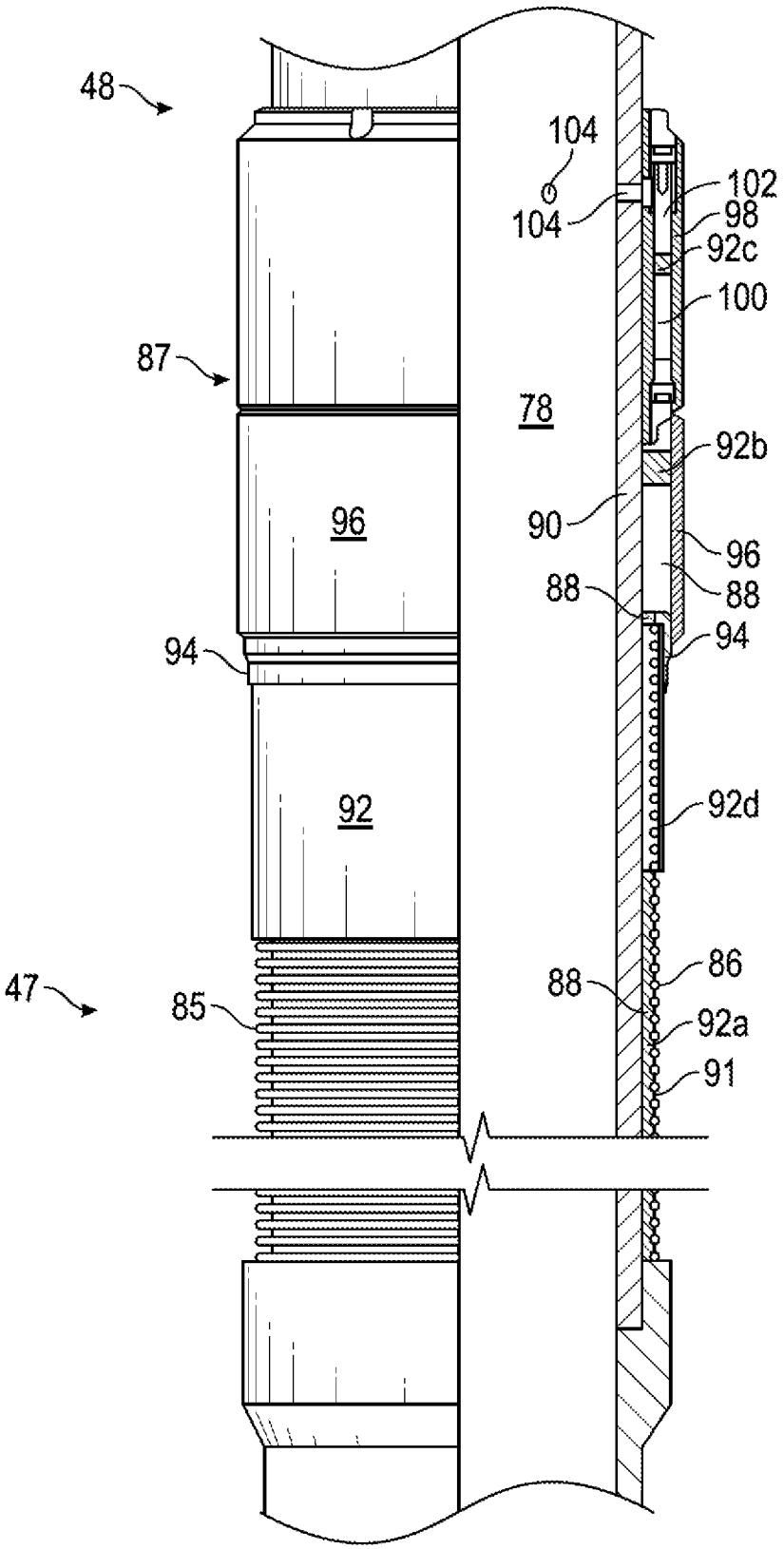
FIG. 4 illustrates a partial cross sectional view of the lower production assembly of FIG. 3, but with dissolvable material installed, according to an exemplary embodiment of the present disclosure.

FIG. 4 illustrates a partial cross sectional view of the flow regulating system 48 and screen assembly 47 of FIG. 3, but with dissolvable material 92 installed to block flow into interior flow passage 78 of base pipe 90. In one or more embodiments, dissolvable material 92 is deployed in the openings or entry points 91 of screen 85, as shown by dissolvable material 92*a*. In one or more embodiments, dissolvable material 92 is deployed in passage 88 in the form of a plug, as shown by dissolvable material 92*b*. In one or more embodiments, dissolvable material 92 is deployed in chamber 102 in the form of a plug, as shown by dissolvable material 92*c*. Finally, in one or more embodiments, dissolvable material 92 in the form of a shroud may be placed over screen 85, as shown by dissolvable material 92*d*. For illustrative purposes, shroud 92*d* is only covering a portion of screen 85, but it will be appreciated that in one or more embodiments, dissolvable shroud 92*d* will fully cover screen 85 and the openings 91 formed therein. In other embodiments, the dissolvable material 92 may be deployed in various combinations, such as a portion of the material 92*a* disposed in the openings 91, and another portion of material 92*d* covering a portion of the screen 85. Persons of ordinary skill in the art will appreciate that dissolvable material 92 may be deployed anywhere along the fluid flow path that passes through flow regulating system 48 so long as fluid communication into interior flow passage 78 of base pipe 90 is temporarily block during one-trip run-in and deployment of production string 10.

Dissolvable material 92 may be any material that can be readily removed chemically or mechanically to establish flow through flow regulating system 48. In one or more embodiments, dissolvable material 92 may be a material that can be chemically removed by dissolving the material in the presence of a fluid, such as a wellbore fluid or breaker fluid, once run-in and deployment are complete.

In other embodiments of flow regulating system 48, dissolvable material 92 may be replaced with a mechanical sleeve or valve disposed along base pipe 90 or otherwise adjacent screen 85 that may be actuated to prevent flow through the screen assembly as described herein. It will be appreciated that by incorporating dissolvable material 92 into the screen openings 91 or as otherwise described herein, or by otherwise blocking flow through flow regulating system 48, flow regulating system 48 effectively can function as a solid pipe (such as during run-in and flow down operations) until the dissolvable material is removed. As such, the need for an inner string during run-in is avoided, and hence, the need for an additional trip to pull the inner string out of the wellbore before tripping in the upper completion assembly is obviated.

Figure 5A:
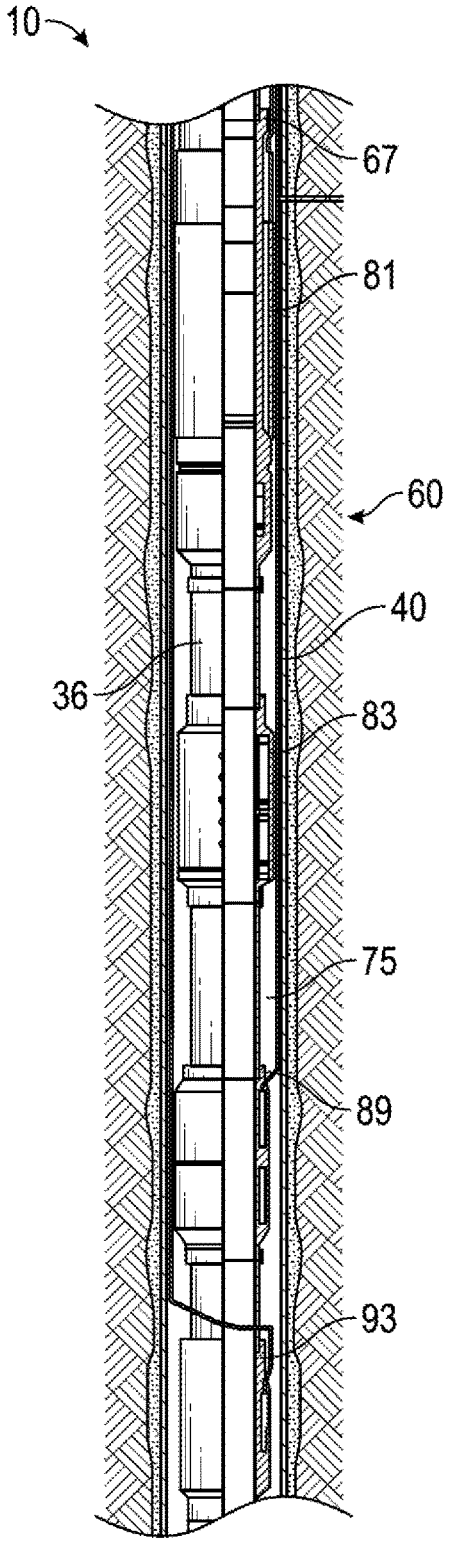
FIGS. 5A-5E illustrate the production string of the disclosure deployed in a wellbore.
Figure 5B:
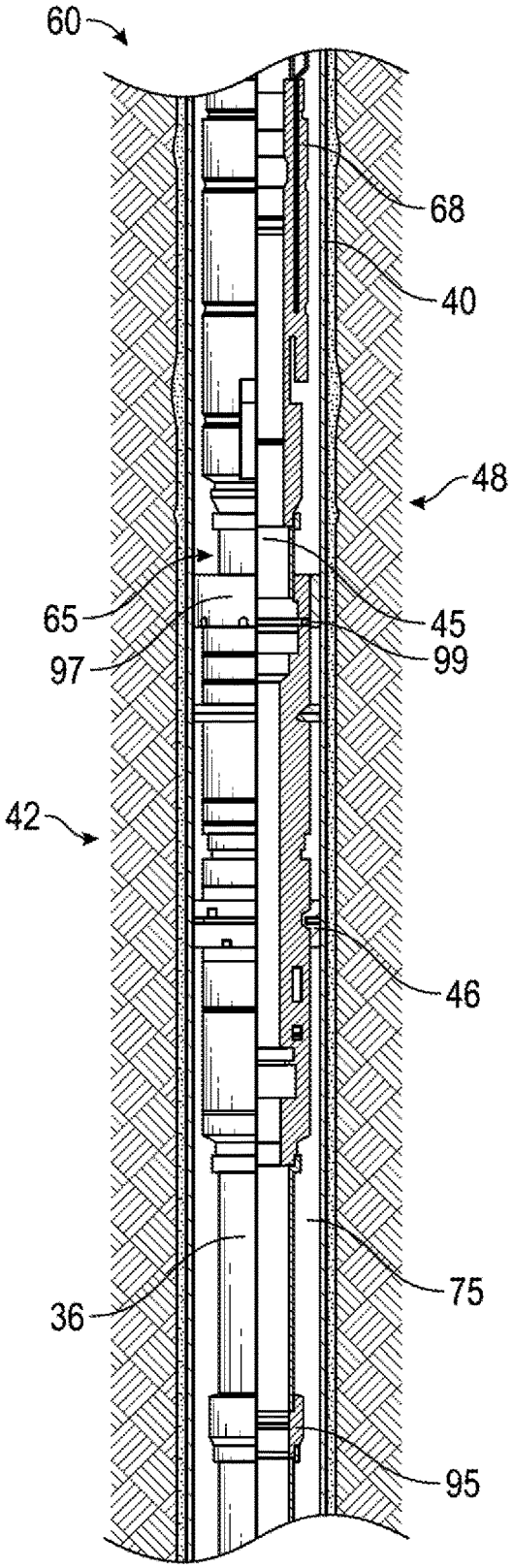
Figure 5C:
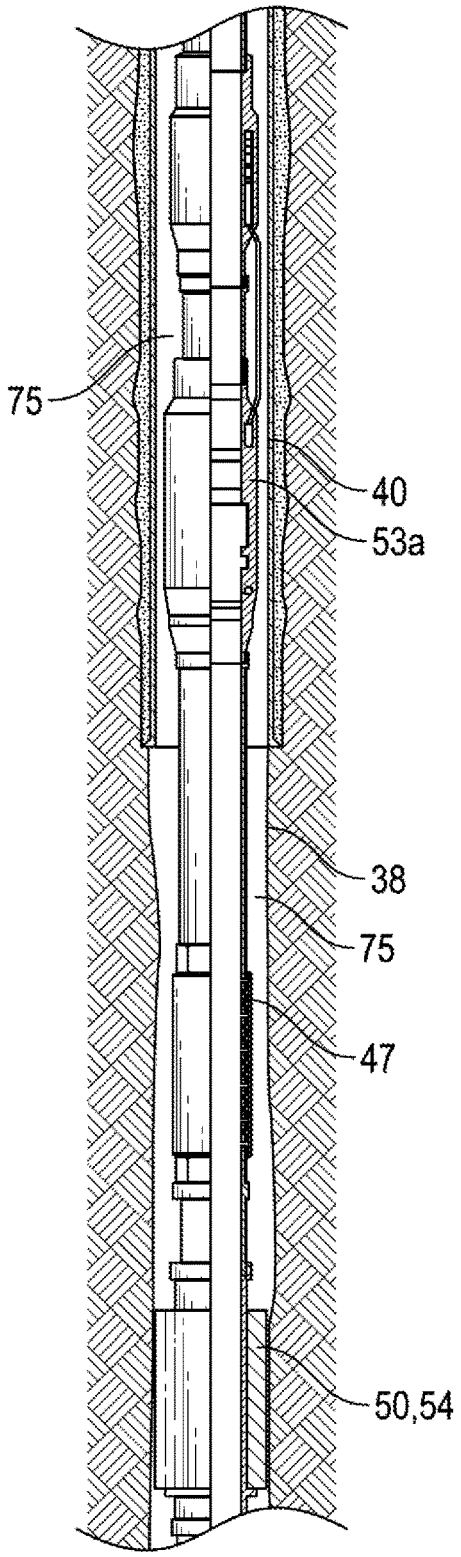
Figure 5D:
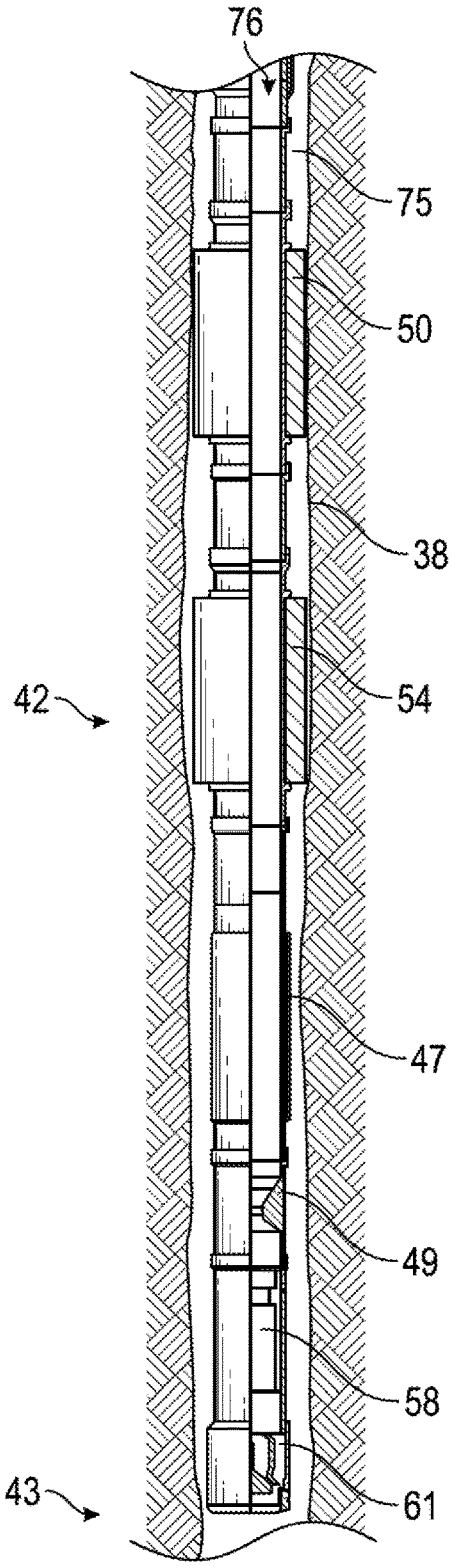

FIGS. 5A-5E illustrate various embodiments of production string 10 having a flow regulating system 48 as described herein. It will be appreciated that the production string 10 having a flow regulating system 48 may be utilized with a variety of other components, none of which are intended to be limiting. Thus, in FIG. 5A, various possible components of a production string 10, and in particular, an upper portion 60 thereof, are illustrated. Production string 10 may include one or more of a safety valve 81, a gas lift mandrel 83, a downhole gauge system 89 and a chemical injection system 93 carried by tubing string 36. Continuing down the upper portion 60, as best seen in FIG. 5B, production string 10 includes an upper circulation valve 68, which upper circulation valve 68 forms part of flow regulating system 48. In one or more embodiments, upper circulation valve 68 may be remotely actuated, such as through the transmission of an acoustic signal, while in other embodiments, a control line running from platform 11 may be utilized to actuate upper circulation valve 68. In one or more embodiments, upper circulation valve 68 is non-shrouded. In one or more embodiments, upper circulation valve 68 may be deployed adjacent the distal end 65 of upper portion 60. It will be appreciated that when deployed adjacent the distal end 65, and more specifically, adjacent packer 46, then flow down operations for cleaning debris from annulus 75 are most effective. In any event, in FIG. 5B, below upper circulation valve 68 is packer 46. In one or more embodiments, packer 46 is a production packer that may be retrievable. In one or more embodiments, packer 46 is a pass-through packer, thereby allowing communication lines and cables to extend below packer 46. Moreover, packer 46 may be actuated remotely by pressuring up the interior of string 36. While various methods may be utilized to apply pressure to packer 46 to actuate packer 46 and deploy it, in one or more embodiments, an object (not shown) such as a ball or dart may be released into the wellbore 38 and seated on seat 49 (FIG. 5D). In other embodiments, valve 53*a* may be closed. In any event, a nipple 95 may be deployed along string 36.

In one or more embodiments, a basket 97 may be provided upstream of packer 46 to catch debris in annulus 75 that would otherwise collect around packer 46. Basket 97 may be retrievable. Basket 97 may include openings 99 to allow fluid to pass therethrough, while filtering out debris that could otherwise collect around packer 46.

Figure 5E:
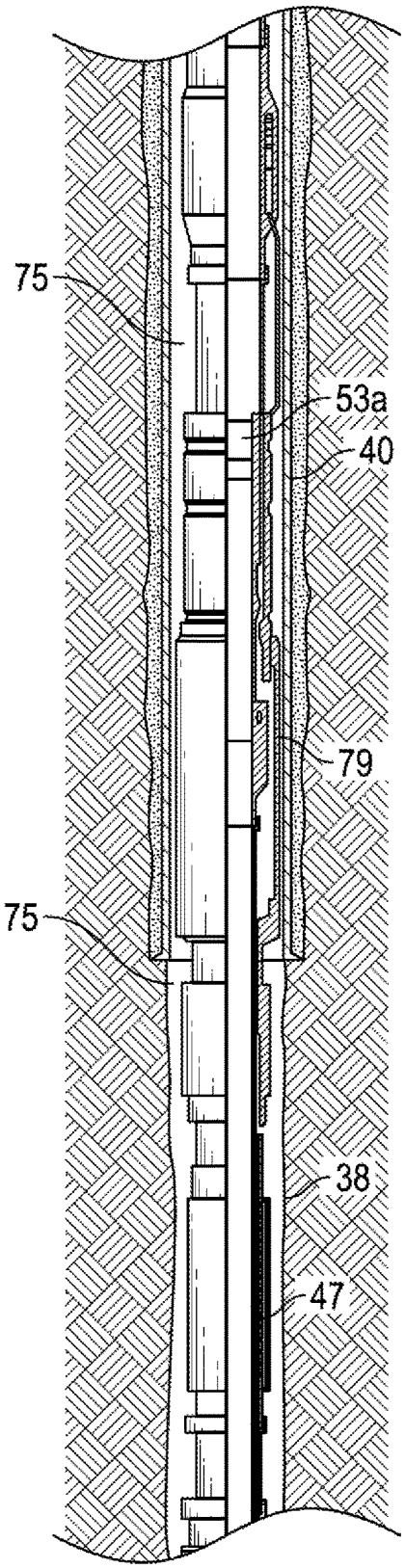

Continuing down production string 10, in FIG. 5C and alternatively, in FIG. 5E, valve 53*a* is illustrated. To the extent production string 10 is deployed at least partially in an open hole, valve 53*a* is preferably positioned within the cased portion of wellbore 38 as illustrated. Regardless of its type, valve 53*a* may be remotely actuated, such as through the transmission of an acoustic signal, while in other embodiments, a control line (not shown) running from platform 11 may be utilized to actuate valve 53*a*. In these embodiments, packer 46 preferably is a pass-through packer to allow the control lines (not shown) to extend to valve 53*a*. In one or more embodiments such as is shown in FIG. 5C, valve 53*a* is an isolation barrier valve, while in other embodiments such as is shown in FIG. 5E, valve 53*a* is a circulation valve. Circulation valve 53*a* as shown in FIG. 5E may include a shroud 79.

Below valve 53*a* is a screen assembly 47. In one or more embodiments, screen assembly 47 may include dissolvable material 92 to inhibit flow through screen 85 or otherwise, to inhibit flow through openings 104 (FIG. 4). In one or more embodiments where valve 53*a* is an isolation barrier valve, screen assembly 47 may include a screen 85 with dissolvable material 92 disposed in entry points 91 (FIG. 4). In such embodiments, screen 85 may be a swell screen. Likewise, in one or more embodiments where valve 53*a* is a shrouded circulation valve, screen assembly 47 may include a convention screen 85 without dissolvable material 92. In one or more embodiments, a plurality of spaced apart screen assemblies 47 may be provided below valve 53*a*.

As illustrated in FIG. 5D, below screen assembly 47, in one or more embodiments, additional packers 50, 54 may be provided. The packers 50, 54 may be swell packers. The packers 50, 54 may be utilized to isolate production zones and/or provide stability to wellbore 38. In one or more embodiments, a seat 49 may be provided for receipt of a releasable object (not shown) dropped or pumped down the well to allow the pressure upstream of the seat 49 to be increased by landing an object on the seat 49 as is well known in the industry. Seat 49 may be a ball seat and the object may be a ball. Below seat 49, a flow around sub 58 with a packer may be provided. Finally, below sub 58, at distal end 43 of lower portion 42, a float shoe 61 may be provided. As described above, fluid 76 may be pumped down interior 78 of production string 10 and out into annulus 75.

Persons of ordinary skill in the art will appreciate that the descriptions of production string 10 as having upper and lower portions is not intended to be limiting, but is simply included to establish the relative axial positioning of components of the flow regulating system 48.

Figure 6:
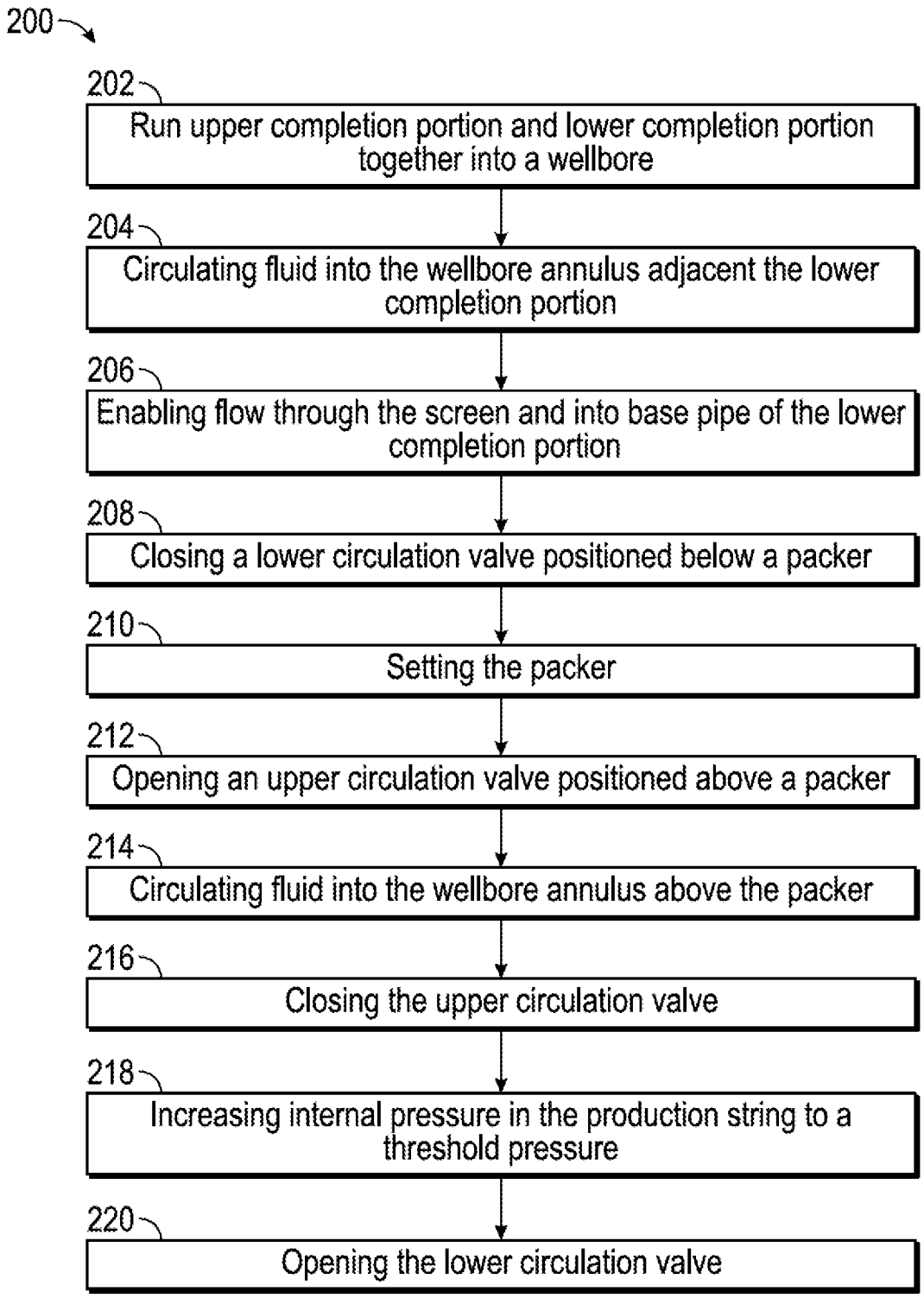
FIG. 6 illustrates a method of installing production string, according to an exemplary embodiment of the present disclosure.

In an exemplary embodiment and as illustrated in FIG. 6 with continuing reference to FIGS. 1-5, a method 200 of installing production string 10 is described. In a first step 202, a production string 10 having an upper completion portion 60 and a lower completion portion 42 is run together into a wellbore 38. The production string 10 is made up prior to running the production string into the wellbore 38. As part of the lower completion portion 42, the production string 10 includes at least one screen assembly 47, at least one packer 46 and at least one lower valve 53*a*. The lower valve 53*a* is positioned below the packer 46 so that the valve can be actuated to allow fluid in the interior of production string 10 to flow to the distal end 43 of the lower completion portion 42, and then out into the annulus 75. The lower valve 53*a* may be a remotely controlled isolation barrier valve. The lower valve 53*a* is set into a first open position during run-in. The screen assembly 47 is configured to prevent fluids from flowing therethrough, i.e., through the screen 85 and into the interior of the base pipe 90. This configuration may include a dissolvable material 92 deployed along a flow path 88 of the screen assembly 47 to prevent flow of fluid through the screen assembly, i.e., from the annulus 75 to the interior of base pipe 90. In other embodiments, this configuration may include a mechanical sleeve or valve that may be actuated to prevent flow through the screen assembly. Such actuation may be remotely accomplished through application of a fluid pressure or from a signal transmitted thereto.

As part of the upper completion portion 60, the production string 10 includes at least one upper valve 68. Upper valve 68 may be a circulation valve. In one or more embodiments, circulation valve 68 is not shrouded. The upper circulation valve 68 is set into a first closed position during run-in. The upper circulation valve 68 may be a remotely controlled isolation barrier valve. In any event, the production string 36 is run-in the wellbore 38 to the desired position. Positioning may be accomplished by running the production string in a tubing string until a desired point is reached, at which point a tubing hanger may be attached to the tubing string. Thereafter, the tubing hanger may be landed on a tubing head spool to position the production string. It will be appreciated that the disclosure is not limited to the manner of positioning of the production string so long as the production string includes both the upper and lower completion assemblies so as to avoid the need for a second trip in.

It will be appreciated that in one or more embodiments, production string 10 may further include a seat 49 and a float shoe 61 below screen assembly 47. Likewise, production string 10 may include a flow around sub 58 adjacent float shoe 61.

In step 204, once the production string 10 is positioned, fluid is circulated down the production string and into the annulus 75 surrounding the lower completion assembly. In particular, the fluid is circulated down through the lower completion portion 42 and is introduced in the annulus 75 below the screen assembly 47 of the lower completion portion 42. Because the flow path through the screen assembly is blocked, the circulating fluid passes axially through the annulus or inner passage of the lower completion portion as if it were a solid pipe. Flow from the lower completion portion 42 is then directed into the annulus 75, where the flow travels up through the annulus to the surface. It will be appreciated that during this step 204, production packer 46 has not been activated. As such, fluid can flow in annulus 75 past production packer 46 to the surface to flush annulus 75.

In step 206, flow through the screen 85 and into the base pipe 90 is enabled. In some embodiments, this may be accomplished by circulating a fluid down the production string 10 and into contact with a dissolvable material 92 of the lower completion assembly. In some embodiments, this may be accomplished by actuating a sleeve 92 or valve adjacent the base pipe 90 to permit fluid to flow through the screen 85 and into the interior of the base pipe 90. To the extent dissolvable material 92 is utilized to inhibit flow therebetween, the fluid may be a breaker fluid that chemically interacts with the dissolvable material. In one or more embodiments, a material disposed in the openings of the screen 85 is dissolved utilizing the fluid to permit fluid flow through the screen. In one or more embodiments, a plug 92*a* disposed in the openings of the screen 85 or along a flow channel 88 of the lower completion assembly 42 is dissolved utilizing the fluid to permit fluid flow through the screen 85 and into the base pipe 90. In one or more embodiments, the fluid may be the same fluid utilized during the circulating step 204, in which case, the dissolvable material 92 begins to dissolve during step 204 so that upon completion of step 204, or following a period of time thereafter, the dissolvable material has been dissolved and flow through the screen and into the base pipe is enabled.

In step 208, the lower circulation valve 53*a* is actuated to move from first open position to second closed position. This actuation may be accomplished remotely. Remote operation may occur utilizing a signal, such as an electrical, optic or acoustic pulse transmitted from the surface or otherwise, locally transmitted from a signal source in the vicinity of the valve. In one or more embodiments, such actuation may be accomplished utilizing a fluid pressure or a pressure differential. In one or more embodiments, such actuation may be accomplished utilizing a timer activated valve, such that the valve would actuate after a period of time t following a given action, such as deployment. In one or more embodiments, the lower circulation valve may include a differential trigger mechanism to cycle open or closed when a particular low or high pressure threshold is reached. It will be appreciated that by closing valve 53*a*, the lower completion portion 42, and in particular, fluid 76 flowing from the formation into the lower completion portion 42, is isolated from the upper completion portion 60.

In step 210, the production packer 46 located above the lower circulation valve 53*a* is set. Packer 46 may be set utilizing any known techniques. In one or more embodiments, packer 46 may be set by releasing a ball, dart or similar releasable object in order to apply a setting pressure to the packer 46. In one or more embodiments, the packer 46 may be set by closing all valves and applying a setting pressure to the packer 46. This may be utilized in conjunction with the aforementioned releasable object. It will be appreciated that in cases where packer 46 is activated utilizing a seat, such as seat 49, that is below valve 53*a*, then valve 53*a* will remain open until after packer 46 is set. Alternatively, valve 53*a* may be closed to apply a setting pressure to packer 46.

In step 212, the upper circulation valve 68 is actuated to move from the first closed position to the second open position. This actuation may be accomplished remotely. Remote operation may occur utilizing a signal, such as an electrical, optic or acoustic pulse transmitted from the surface or otherwise, locally transmitted from a signal source in the vicinity of the valve. In one or more embodiments, such actuation may be accomplished utilizing a fluid pressure or a pressure differential. In one or more embodiments, such actuation may be accomplished utilizing timer activated valve, such that the valve would actuate after a period of time t following a given action, such as deployment. In one or more embodiments, the upper circulation valve may include a differential trigger mechanism to cycle open or closed when a particular low or high pressure threshold is reached.

In step 214, with the upper circulation valve 68 open, the annulus 75 above packer 46 is circulated to displace wellbore fluid in the annulus. In this step, it will be appreciated that lower circulation valve 53*a* is closed, such that a circulation fluid pumped down through the upper completion assembly will be directed out into the annulus 75 about the upper completion portion 60. In one or more embodiments, the circulation fluid pumped down in this step 214 may be brine or any other fluid utilized for such purpose.

In step 216, once circulation in the upper portion of the wellbore, i.e., above packer 46, is complete, upper circulation valve 68 is actuated from the second open position back to the first closed position. This actuation may be accomplished as described above.

Once step 216 is complete, the well may thereafter be produced as is well known in the art.

In one or more embodiments, additional procedures may be performed to ensure that the production string has been deployed as desired. Thus, in a step 218, pressure may be applied internally to the production string 10 to a threshold pressure to ensure string integrity. Likewise, annular pressure may be increased to a threshold pressure to ensure desired operation of the packer. Thereafter, the tubing pressure and annular pressure may be bled off. In step 220, the lower circulation valve 53*a* may be actuated from a second closed position to a first open position.

Figure 7:
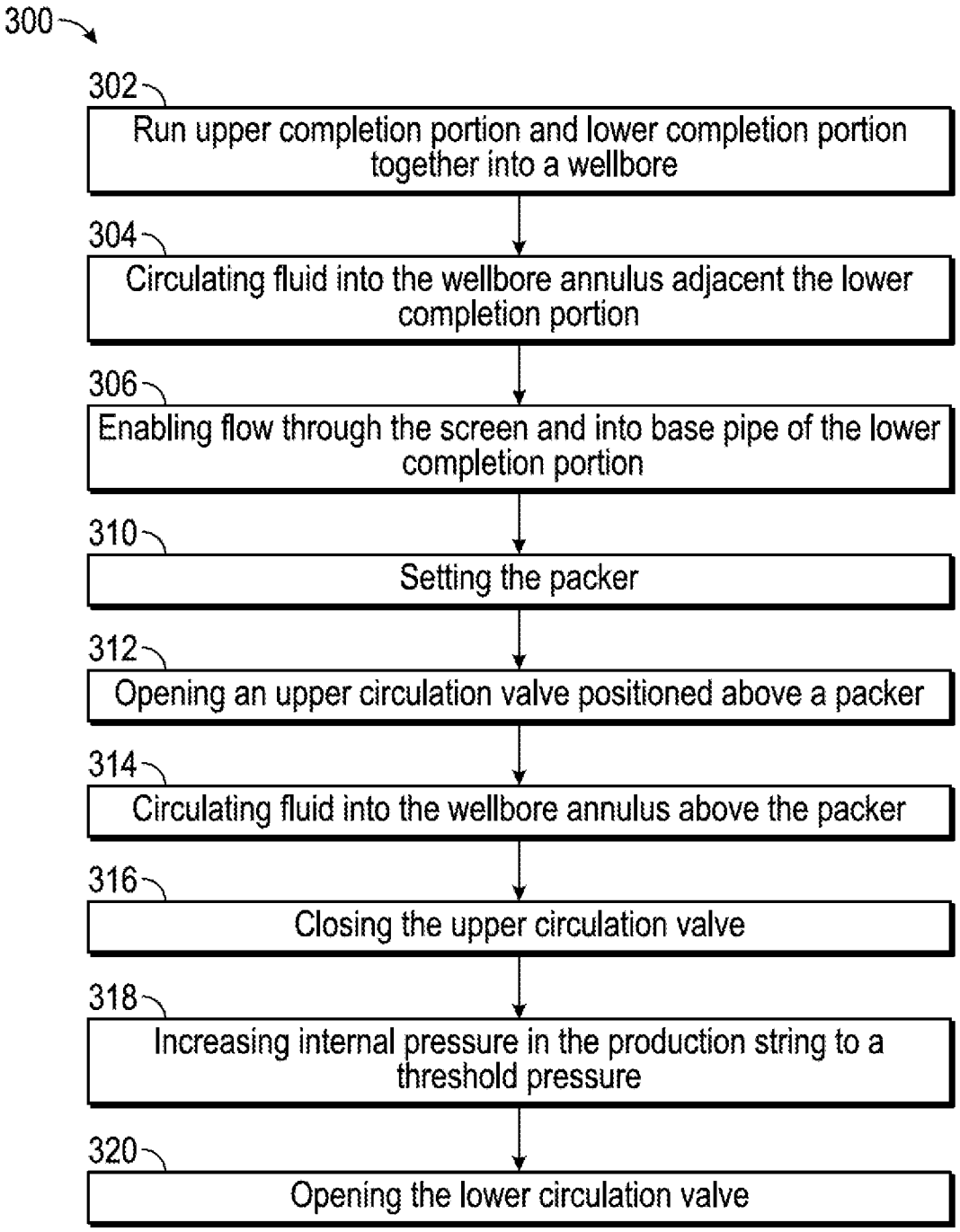
FIG. 7 illustrates a method of installing production string, according to an exemplary embodiment of the present disclosure.

In an exemplary embodiment and as illustrated in FIG. 7 with continuing reference to FIGS. 1-5, a method 300 of installing production string 10 is described. In a first step 302, a production string 10 having an upper completion portion 60 and a lower completion portion 42 is run together into a wellbore 38. The production string 10 is made up prior to running the production string into the wellbore 38. As part of the lower completion portion 42, the production string 10 includes at least one screen assembly 47, at least one packer 46 and at least one lower valve 53*a*. In some embodiments, valve 53*a* is a circulation valve. In one or more embodiments where valve 53*a* is a circulation valve, circulation valve 53*a* is shrouded. In one or more embodiments, the lower circulation valve 53*a* is positioned below the packer 46 so that the valve can be actuated to control flow of fluid through the production string 10 to the lower completion portion 42. The lower circulation valve 53*a* may be a remotely controlled circulating valve. In one or more embodiments, lower circulation valve 53*a* is set in a closed position during run-in. The screen assembly 47 is configured to prevent fluids from flowing therethrough, i.e., through the screen 85 and into the interior of the base pipe 90. This configuration may include a dissolvable material 92 deployed along a flow path 88 of the screen assembly 47 to prevent flow of fluid through the screen assembly, i.e., from the annulus 75 to the interior of base pipe 90. In other embodiments, this configuration may include a mechanical sleeve or valve that may be actuated to prevent flow through the screen assembly. Such actuation may be remotely accomplished through application of a fluid pressure or from a signal transmitted thereto.

As part of the upper completion portion 60, the production string 10 includes at least one upper circulation valve 68. The upper circulation valve 68 may be a remotely controlled circulating valve. The upper circulation valve 68 is set in a closed position during run-in. In any event, the production string 10 is run-in the wellbore to the desired position. Positioning may be accomplished by running the production string in a tubing string until a desired point is reached, at which point a tubing hanger may be attached to the tubing string. Thereafter, the tubing hanger may be landed on a tubing head spool to position the production string. It will be appreciated that the disclosure is not limited to the manner of positioning of the production string so long as the production string includes both the upper and lower completion portions so as to avoid the need for a second trip in for installing the production string.

It will be appreciated that in one or more embodiments, production string 10 may further include a seat 49 and a float shoe 61 below screen assembly 47. Likewise, production string 10 may include a flow around sub 58 adjacent float shoe 61. Additionally, in this embodiment, an absolute isolation string (AIS) is preferably included below the conventional screen assembly.

In step 304, once the production string 10 is positioned, fluid is circulated down the production string and into the annulus 75 surrounding the lower completion portion 42. In particular, the fluid is circulated down through the lower completion portion 42 and is introduced in the annulus 75 below the screen assembly 47 of the lower completion portion 42. Because the flow path through the screen assembly is blocked, the circulating fluid passes axially through the annulus or inner passage of the lower completion assembly as if it were a solid pipe. Flow from the lower completion portion 42 is then directed into the annulus 75, where the flow travels up through the annulus to the valve 53*a*, as which point, valve 53*a* directs the flow along a desired flowpath. In one more embodiments, a shroud 79 of valve 53*a* is utilized to direct flow into the interior of the production string.

In step 306, flow through the screen 85 and into the base pipe 90 is enabled. In some embodiments, this may be accomplished by circulating a fluid down the production string 10 and into contact with a dissolvable material 92 of the lower completion assembly. In some embodiments, this may be accomplished by actuating a sleeve 92 or valve adjacent the base pipe 90 to permit fluid to flow through the screen 85 and into the interior of the base pipe 90. To the extent dissolvable material 92 is utilized to inhibit flow therebetween, the fluid may be a breaker fluid that chemically interacts with the dissolvable material. In one or more embodiments, a material disposed in the openings of the screen 85 is dissolved utilizing the fluid to permit fluid flow through the screen. In one or more embodiments, a plug 92*a* disposed in the openings of the screen 85 or along a flow channel 88 of the lower completion assembly 42 is dissolved utilizing the fluid to permit fluid flow through the screen 85 and into the base pipe 90. In one or more embodiments, the fluid may be the same fluid utilized during the circulating step 304, in which case, the dissolvable material 92 begins to dissolve during step 304 so that upon completion of step 304, or following a period of time thereafter, the dissolvable material has been dissolved and flow through the screen and into the base pipe is enabled.

In step 310, the production packer 46 located above the lower circulation valve 53*a* is set. Packer 46 may be set utilizing any known techniques. In one or more embodiments, packer 46 may be set by releasing a ball, dart or similar releasable object in order to apply a setting pressure to the packer 46. In one or more embodiments, the packer 46 may be set by closing all valves and applying a setting pressure to the packer 46. This may be utilized in conjunction with the aforementioned releasable object. It will be appreciated that in cases where packer 46 is activated utilizing a seat, such as seat 49, that is below valve 53*a*, then valve 53*a* will remain open until after packer 46 is set. Alternatively, valve 53*a* may be closed in order to apply a setting pressure to packer 46.

In step 312, the upper circulation valve 68 is actuated to move from the first closed position to the second open position. This actuation may be accomplished remotely. Remote operation may occur utilizing a signal, such as an electrical, optic or acoustic pulse transmitted from the surface or otherwise, locally transmitted from a signal source in the vicinity of the valve. In one or more embodiments, such actuation may be accomplished utilizing a fluid pressure or a pressure differential. In one or more embodiments, such actuation may be accomplished utilizing timer activated valve, such that the valve would actuate after a period of time t following a given action, such as deployment. In one or more embodiments, the upper circulation valve may include a differential trigger mechanism to cycle open or closed when a particular low or high pressure threshold is reached.

In step 314, with the upper circulation valve 68 open, the annulus 75 above packer 46 is circulated to displace wellbore fluid in the annulus. In this step, it will be appreciated that lower circulation valve 53*a* is closed, such that a circulation fluid pumped down through the upper completion assembly will be directed out into the annulus 75 about the upper completion portion 60. In one or more embodiments, the circulation fluid pumped down in this step 214 may be brine or any other fluid utilized for such purpose.

In step 316, once circulation in the upper portion of the wellbore, i.e., above packer 46, is complete, upper circulation valve 68 is actuated from the second open position back to the first closed position. This actuation may be accomplished as described above.

Once step 316 is complete, the well may thereafter be produced as is well known in the art.

In one or more embodiments, additional procedures may be performed to ensure that the production string has been deployed as desired. Thus, in a step 318, pressure may be applied internally to the production string 10 to a threshold pressure to ensure string integrity. Likewise, annular pressure may be increased to a threshold pressure to ensure desired operation of the packer. Thereafter, the tubing pressure and annular pressure may be bled off. In step 320, the lower circulation valve 53*a* may be actuated from a second closed position to a first open position.

Thus, a method for installing a production string in a wellbore has been described. The method may generally include deploying a lower completion portion and an upper completion portion together into a wellbore at the same time; circulating fluid down through the lower completion portion and into the wellbore annulus adjacent the lower completion portion; following the step of circulating through the lower completion portion, enabling flow through a screen and into a base pipe of the lower completion portion; actuating a lower circulation valve to move the lower circulation valve from a first open position to a second closed position; setting a packer positioned above the lower circulation valve; actuating an upper circulation valve to move the upper circulation valve from a first closed position to a second open position; with the upper circulation valve in the second open position, circulating fluid down through the upper completion portion and into the wellbore annulus above the packer; and following the step of circulating through the upper completion portion, actuating the upper circulation valve to move the upper circulation valve from the second open position to the first closed position. Likewise, a method for installing a production string in a wellbore may generally include deploying a lower completion portion and an upper completion portion together into a wellbore at the same time; circulating fluid down through the lower completion portion and into the wellbore annulus adjacent the lower completion portion; following the step of circulating through the lower completion portion, enabling flow through a screen and into a base pipe of the lower completion portion; setting a packer positioned above a lower circulation valve; actuating an upper circulation valve to move the upper circulation valve from a closed position to an open position; with the upper circulation valve in the open position, circulating fluid down through the upper completion portion and into the wellbore annulus above the packer; and following the step of circulating through the upper completion portion, actuating the upper circulation valve to move the upper circulation valve from the open position to the closed position.

For the foregoing embodiments, the method may include any one of the following steps, alone or in combination with each other:

Producing hydrocarbons from the wellbore once the step of circulating the upper completion portion is complete.

Circulating fluid through the lower completion portion comprises blocking the circulating flow from passing through a screen and into the lower completion portion.

The deploying step comprises configuring, prior to run-in, the upper completion portion to have the upper circulation valve in the first closed position above the packer and configuring, prior to run-in, the lower completion portion to have the lower circulation valve in the first open position below the packer in the production string.

Increasing internal pressure within the production string to a threshold pressure to ensure string integrity; increasing annular pressure to a threshold pressure to ensure desired operation of the packer; bleeding off the internal and annular applied pressures; and actuating the lower circulation valve from the second closed position to the first open position.

Producing hydrocarbons from the wellbore once the step of circulating the upper completion portion is complete.

The setting the packer step comprises releasing an object into the wellbore; landing the object at a location below the packer to inhibit flow past the packer; and increasing fluid pressure in the wellbore above the object to set the packer.

The setting the packer step comprises increasing fluid pressure in the wellbore while the upper circulation valve is in the first closed position and the lower circulation valve is in the second closed position; and utilizing the increase in fluid pressure to actuate the packer.

The circulating fluid through the lower completion portion step comprises blocking the circulating flow from passing through the screen and into the lower completion portion.

The deploying step comprises configuring, prior to run-in, the upper completion portion to have the upper circulation valve in the closed position above the packer and configuring, prior to run-in, the lower completion portion to have the lower circulation valve in a closed position below the packer in the production string.

Producing hydrocarbons from the wellbore once the step of circulating the upper completion portion is complete.

Increasing internal pressure within the production string to a threshold pressure to ensure string integrity; increasing annular pressure to a threshold pressure to ensure desired operation of the packer; bleeding off the internal and annular applied pressures; and actuating the lower circulation valve from a closed position to an open position.

The setting the packer step comprises releasing an object into the wellbore; landing the object at a location below the packer to inhibit flow past the packer; and increasing fluid pressure in the wellbore above the releasable object to set the packer.

The enabling flow through the screen and into the base pipe of the lower completion portion step comprises dissolving a plug blocking flow through the lower completion portion.

The dissolving step comprises dissolving a material in openings of the screen thereby permitting a fluid to flow through the screen.

The dissolving step comprises dissolving a material in a flow passage of the lower completion portion.

The dissolving step comprises dissolving a material covering openings of the screen thereby permitting a fluid to flow through the screen.

The lower circulation valve is actuated remotely by a signal from the surface.

The upper circulation valve is actuated remotely by a signal from the surface.

A production assembly for deployment in hydrocarbon recovery operations has been described. Embodiments of the assembly may generally include an upper completion portion comprising a tubular characterized by an interior and an exterior and an upper circulation valve movable between a closed position to block fluid communication between the interior and the exterior of the tubular and an open position to establish fluid communication between the interior and the exterior of the tubular; a lower completion portion attached to the upper completion portion, the lower completion portion comprising at least one screen assembly having a screen deployed adjacent a base pipe characterized by an interior and exterior with a flow path defined through the screen from the exterior to the interior of the base pipe, at least one packer and at least one lower circulation valve movable between an open position to establish fluid communication between the interior and the exterior of the base pipe and a closed position to block fluid communication between the interior and the exterior of the base pipe, the screen assembly further comprising a dissolvable material deployed along the flow path to prevent fluid flow along the flow path. Likewise, an assembly for deployment in a wellbore may generally include a plug deployed in a wellbore; a production string having an upper completion portion and a lower completion portion, wherein the lower completion portion is spaced apart from the plug; an upper completion portion comprising a tubular characterized by an interior and an exterior and an upper circulation valve movable between a closed position to block fluid communication between the interior and the exterior and an open position to establish fluid communication between the interior and the exterior of the tubular; a lower completion portion attached to the upper completion portion, the lower completion portion comprising at least one screen assembly having a screen deployed adjacent a base pipe characterized by an interior and exterior with a flow path defined through the screen from the exterior to the interior of the base pipe, at least one packer and at least one lower circulation valve movable between an open position to establish fluid communication between the interior and the exterior of the base pipe and a closed position to block fluid communication between the interior and the exterior of the base pipe, the screen assembly further comprising a dissolvable material deployed along the flow path to prevent fluid flow along the flow path.

For any of the foregoing embodiments, assembly may include any one of the following elements, alone or in combination with each other:

The screen comprises a multiplicity of openings, wherein the dissolvable material is deployed in the openings of the screen.

The upper circulation valve is a remotely controlled circulating valve and the lower circulation valve is a remotely controlled isolation barrier valve.

The dissolvable material is a dissolvable shroud deployed over the openings of the screen.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A method of installing a production string in a wellbore, the method comprising:

deploying a lower completion portion and an upper completion portion together into a wellbore at the same time;

circulating fluid down through the lower completion portion and into the wellbore annulus adjacent the lower completion portion;

following the step of circulating through the lower completion portion, enabling flow through a screen and into a base pipe of the lower completion portion;

actuating a lower circulation valve to move the lower circulation valve from a first open position to a second closed position;

setting a packer positioned above the lower circulation valve;

actuating an upper circulation valve to move the upper circulation valve from a first closed position to a second open position;

with the upper circulation valve in the second open position, circulating fluid down through the upper completion portion and into the wellbore annulus above the packer;

following the step of circulating through the upper completion portion, actuating the upper circulation valve to move the upper circulation valve from the second open position to the first closed position;

increasing internal pressure within the production string to a threshold pressure to ensure string integrity;

increasing annular pressure to a threshold pressure to ensure desired operation of the packer;

bleeding off the internal and annular applied pressures; and actuating the lower circulation valve from the second closed position to the first open position.

2. The method of claim 1, further comprising producing hydrocarbons from the wellbore once the step of circulating the upper completion portion is complete.

3. The method of claim 1, wherein circulating fluid through the lower completion portion comprises blocking the circulating flow from passing through a screen and into the lower completion portion.

4. The method of claim 1, wherein deploying comprises configuring, prior to run-in, the upper completion portion to have the upper circulation valve in the first closed position above the packer and configuring, prior to run-in, the lower completion portion to have the lower circulation valve in the first open position below the packer in the production string.

5. The method of claim 1, wherein setting the packer comprises:

releasing an object into the wellbore;

landing the object at a location below the packer to inhibit flow past the packer; and increasing fluid pressure in the wellbore above the object to set the packer.

6. The method of claim 1, wherein setting the packer comprises:

increasing fluid pressure in the wellbore while the upper circulation valve is in the first closed position and the lower circulation valve is in the second closed position; and utilizing the increase in fluid pressure to actuate the packer.

7. A method of installing a production string in a wellbore, the method comprising:

deploying a lower completion portion and an upper completion portion together into a wellbore at the same time;

circulating fluid down through the lower completion portion and into the wellbore annulus adjacent the lower completion portion;

following the step of circulating through the lower completion portion, enabling flow through a screen and into a base pipe of the lower completion portion;

setting a packer positioned above a lower circulation valve;

actuating an upper circulation valve to move the upper circulation valve from a closed position to an open position;

with the upper circulation valve in the open position, circulating fluid down through the upper completion portion and into the wellbore annulus above the packer;

following the step of circulating through the upper completion portion, actuating the upper circulation valve to move the upper circulation valve from the open position to the closed position;

increasing internal pressure within the production string to a threshold pressure to ensure string integrity;

increasing annular pressure to a threshold pressure to ensure desired operation of the packer;

bleeding off the internal and annular applied pressures; and actuating the lower circulation valve from a closed position to an open position.

8. The method of claim 7, wherein circulating fluid through the lower completion portion comprises blocking the circulating flow from passing through the screen and into the lower completion portion.

9. The method of claim 7, wherein deploying comprises configuring, prior to run-in, the upper completion portion to have the upper circulation valve in the closed position above the packer and configuring, prior to run-in, the lower completion portion to have the lower circulation valve in a closed position below the packer in the production string.

10. The method of claim 7, further comprising producing hydrocarbons from the wellbore once the step of circulating the upper completion portion is complete.

11. The method of claim 7, wherein setting the packer comprises:

releasing an object into the wellbore;

landing the object at a location below the packer to inhibit flow past the packer; and increasing fluid pressure in the wellbore above the releasable object to set the packer.

12. The method of claim 7, wherein enabling flow through the screen and into the base pipe of the lower completion portion comprises dissolving a plug blocking flow through the lower completion portion.

13. The method of claim 12, wherein dissolving comprises dissolving a material in openings of the screen thereby permitting a fluid to flow through the screen.

14. The method of claim 7, wherein one of the lower circulation valve and the upper circulation valve is actuated remotely by a signal from the surface.

* * * * *